US009631620B2

(12) United States Patent
Nemit, Jr. et al.

(10) Patent No.: US 9,631,620 B2
(45) Date of Patent: Apr. 25, 2017

(54) STATIONARY VOLUME RATIO ADJUSTMENT MECHANISM

(75) Inventors: Paul Nemit, Jr., Waynesboro, PA (US); Timothy I. Auman, Lebanon, PA (US)

(73) Assignee: Johnson Controls Technology Company, Holland, MI (US)

( * ) Notice: Subject to any disclaimer, the term of this patent is extended or adjusted under 35 U.S.C. 154(b) by 949 days.

(21) Appl. No.: 13/367,444

(22) Filed: Feb. 7, 2012

(65) Prior Publication Data

US 2012/0227437 A1 Sep. 13, 2012

Related U.S. Application Data

(60) Provisional application No. 61/451,992, filed on Mar. 11, 2011.

(51) Int. Cl.

| | |
|---|---|
| ***F25B 1/00*** | (2006.01) |
| ***F04C 18/16*** | (2006.01) |
| ***F04C 28/12*** | (2006.01) |

(52) U.S. Cl.

CPC ..... *F04C 18/16* (2013.01); *F04C 28/12* (2013.01)

(58) Field of Classification Search

CPC ..... F04C 18/16; F04C 28/12
USPC ..... 62/498, 115, 215; 418/201.1, 201.2, 19, 418/21

See application file for complete search history.

(56) References Cited

U.S. PATENT DOCUMENTS

| | | | | |
|---|---|---|---|---|
| 3,990,139 | A * | 11/1976 | Touchet | 29/261 |
| 4,159,012 | A * | 6/1979 | Pizzuto et al. | 123/65 R |
| 4,351,160 | A * | 9/1982 | Kountz et al. | 62/201 |
| 4,609,329 | A * | 9/1986 | Pillis et al. | 417/282 |
| 5,408,865 | A * | 4/1995 | Collins et al. | 73/38 |
| 6,672,084 | B2 * | 1/2004 | Cho et al. | 62/114 |
| 7,165,947 | B2 * | 1/2007 | Hattori et al. | 417/53 |
| 7,413,413 | B2 * | 8/2008 | Schnetzka et al. | 417/53 |
| 7,638,818 | B2 * | 12/2009 | Wu et al. | 257/192 |
| 2003/0223882 | A1 * | 12/2003 | Greene, Jr. | 417/212 |
| 2005/0151107 | A1 * | 7/2005 | Shu | 251/214 |

* cited by examiner

*Primary Examiner* — Jianying Atkisson
*Assistant Examiner* — David Teitelbaum
(74) *Attorney, Agent, or Firm* — Fletcher Yoder, P.C.

(57) ABSTRACT

A screw compressor with a volume ratio adjustment mechanism. The volume adjustment mechanism is a penetration in the housing of a screw compressor. The penetration includes one or more apertures. The apertures provide a flow path between the compressor outlet and an interlobe region of the screw compressor rotors. A member resides in the penetration and is movable from a first position in which the apertures are blocked and the flow path is closed and a second position in which the apertures are not blocked and the flow path is open. By unblocking the apertures and opening the flow path, the volume ratio can be adjusted.

16 Claims, 8 Drawing Sheets

STATIONARY VOLUME RATIO ADJUSTMENT MECHANISM

CROSS REFERENCE TO RELATED APPLICATIONS

This patent application claims the benefit of U.S. Provisional Patent Application Ser. No. 61/451,992 filed on Mar. 11, 2011, and entitled "STATIONARY VOLUME RATIO ADJUSTMENT MECHANISM", the disclosure of which is hereby incorporated by reference herein in its entirety and made part of the present U.S. utility patent application for all purposes.

FIELD OF THE INVENTION

The application generally relates to screw compressors used in vapor compression systems and more specifically to a vapor compression system utilizing a variable capacity screw compressor.

BACKGROUND OF THE INVENTION

In positive-displacement compressors, capacity control may be obtained by both speed modulation and suction throttling to reduce the volume of vapor or gas drawn into a compressor. Capacity control for a compressor can provide continuous modulation from 100% capacity to less than 10% capacity, good part-load efficiency, unloaded starting, and unchanged reliability. In some positive-displacement compressors, capacity can also be controlled by a slide valve employed within the compressor. The slide valve can be operated to remove a portion of the vapor from the compression chamber of the compressor, thereby controlling the capacity of the compressor. Besides the slide valve, other mechanical devices, such as slot valves and lift valves, may be employed in positive-displacement compressors to control capacity. Adjustments to capacity control valves or variable displacement mechanisms can meet the demands of the system. In a refrigeration system, capacity can be regulated based upon a temperature setpoint for the space being cooled. In other systems in which the compressor is processing gas, capacity may be regulated to fully load the torque generator or prime mover (turbine or engine drive) for the compressor. However, all of the currently available methods are expensive and add to the initial cost of investment in the equipment.

In chiller applications where economy is desired both in the initial cost of the system and in operation of the system, a variable volume ratio application is desired. The volume, or compression ratio $V_r$ in a screw compressor, is the ratio of the volume of a groove at the start of compression to the volume of the same groove when the discharge port begins to open. Hence, the size and shape of the discharge port is a factor in determining the volume ratio of a screw compressor.

For maximum efficiency, the pressure generated within the grooves during compression should exactly equal the pressure in the discharge line when the volume begins to open to it. If this is not the case, either overcompression or undercompression occurs, both resulting in internal losses. Furthermore, overcompression can harm the compressor. Such losses increase power consumption and noise, while reducing efficiency. Thus, volume ratio selection desirably should be made according to operating conditions when such an adjustment is available.

If the operating conditions of the system seldom change, it is possible to specify a fixed-volume ratio compressor that will provide good efficiency. Because overcompression can damage a compressor, when designing such a compressor, it is designed so that it does not frequently operate in an overcompression mode, if at all. As a result, such a compressor is designed to run at maximum compression under the most severe operating conditions, meaning that such a compressor runs in undercompression modes at all other operating conditions, so that inefficiency may result over extended periods of operation. What is needed is a system that permits adjustments to the volume ratio that changes the volume ratio depending on the conditions that the compressor experiences. This will allow the compressor volume to be adjusted to change the volume, and hence the volume ratio, as operating conditions change, allowing the compressor to operate at maximum efficiency.

SUMMARY OF THE INVENTION

A screw compressor for use in a refrigeration system is provided. The screw compressor includes a motor connected to a power source. A control panel controls operation of the compressor, including the motor and power source. The screw compressor has a variable volume capability. The screw compressor comprises a pair of meshing helical lobed rotors rotating within a fixed housing that are driven by a drive shaft connected to the motor. The housing encloses the rotors or screws, which operate in a working chamber within the housing. The working chamber has a length which varies based on the position of the rotors with respect to one another. The chamber has a maximum length when lobes of the rotor are not aligned with one another. The chamber has a minimum length when the rotors are in meshing alignment with one another.

Refrigerant gas enters the compressor from the suction or low pressure side of the refrigerant circuit through an inlet port when the rotors are arranged in the chamber to maximum length. The space between the lobes of the rotors, the interlobe region, is filled with refrigerant and the inlet port is closed. The refrigerant is compressed between the rotors in the interlobe region as they rotate, compressing the refrigerant gas and raising its pressure. As the highly compressed gas is ejected from the interlobe region, it is expelled into a volume in fluid communication with a discharge port, which ejects the high pressure gas into the refrigeration circuit.

The volume associated with the discharge port, referred to as the discharge port volume, can be varied. The housing adjacent the discharge port volume includes a penetration. This penetration in turn houses a movable member that is accessible from the exterior of the housing. The movable member can be adjusted from the exterior of the housing to open or close one or more apertures, that is, at least one aperture, or any portion of these apertures, to create or eliminate a path between the volume associated with the discharge port and the working chamber. When the movable member is adjusted to open the one or more apertures or a portion of an aperture, the refrigerant, at some point during the compression between the rotors, can follow a path through the one or more apertures to the discharge port without being fully compressed by the rotors. To close this path, the movable member is adjusted to fully close the one or more apertures, so that the refrigerant is compressed fully between the rotors as they rotate. The effect of adjusting the movable member to fully open the path, to fully close the path or to partially open the path by placing the movable member at some point intermediate a fully open position and a fully closed position is to change the compression volume at the discharge point, thereby affecting the volume ratio.

An advantage of a screw compressor of fixed capacity having a volume adjustment mechanism is that a machine can be manufactured and the volume ratio readily can be adjusted to maximize efficiency based on the climate of the area in which it is used without disassembly of the compressor after shipment.

Another advantage of a screw compressor having a volume adjustment mechanism is that a machine can be procured based on a maximum volume ratio for the most severe conditions, but the volume ratio can be adjusted based on seasonal variations by using the volume adjustment feature without disassembly of the compressor so that undercompression can be significantly reduced or completely avoided when conditions are not severe.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
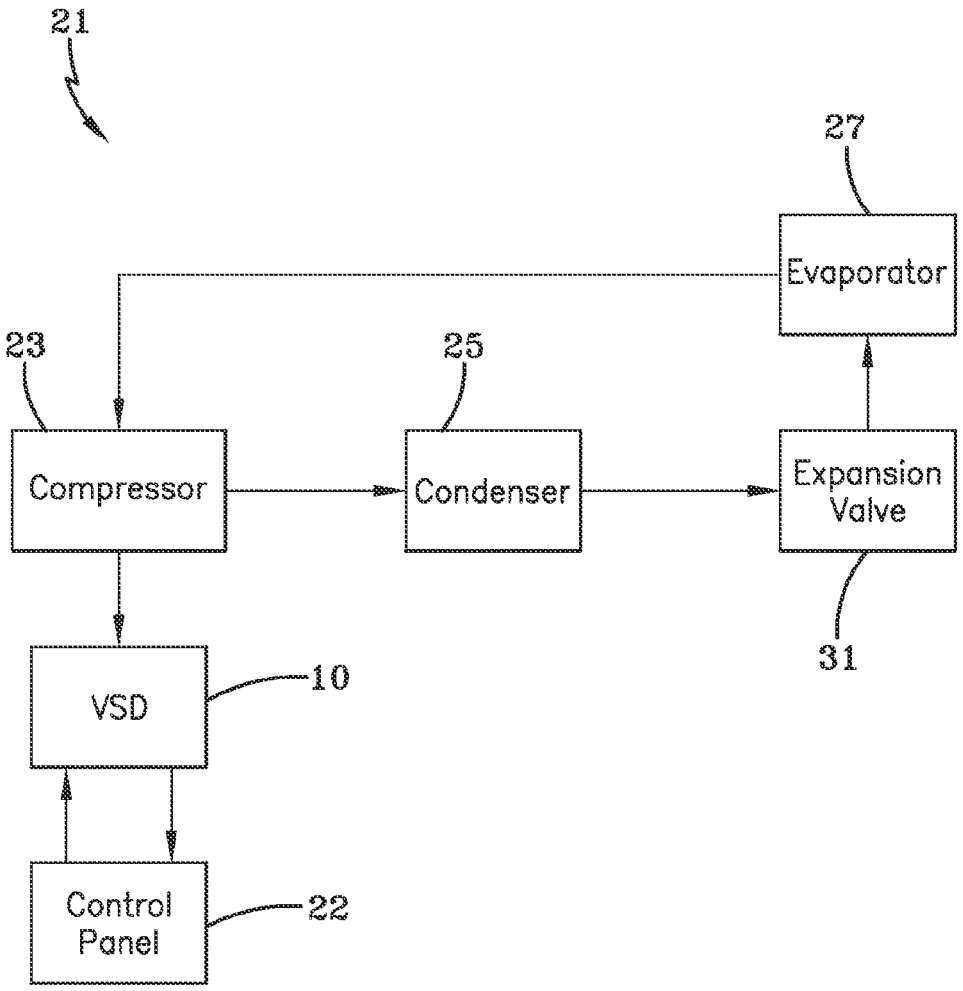
FIG. 1 depicts the refrigeration cycle.

Referring to FIG. 1, an exemplary refrigeration cycle is shown. The refrigeration cycle is a closed loop system 21 in which refrigerant, the working fluid, is compressed by a compressor 23 that increases the pressure of the refrigerant gas. Compressor 23 is driven by a power source 10 that is controlled by a control panel 22. The high pressure refrigerant is in fluid communication with a condenser 25 that condenses the high pressure gas into a pressurized fluid. Condenser 25 is in heat exchange communication with a heat transfer medium that removes heat of condensation resulting from the change of state of refrigerant from gas to liquid. This heat transfer medium may be the atmosphere (air of forced air) or a liquid, preferably water. The high pressure condensed fluid is in fluid communication with an expansion valve 31 that expands at least some of the pressurized fluid into a gas as it flows to an evaporator 27. The closed loop system 21 from the discharge port of compressor 23 to expansion valve 31 is termed the high pressure side of the circuit. After the refrigerant passes through expansion valve 31 as a mixture of gas and liquid, its pressure is reduced. Evaporator 27 receives the refrigerant from expansion valve 31. Evaporator 27 is in heat exchange communication with a heat transfer medium. The heat of absorption is absorbed by the refrigerant in evaporator 27, as liquid refrigerant undergoes a change of state to a vapor. As this heat is absorbed, the heat transfer medium is cooled. The heat transfer medium may be used directly to cool or refrigerate an area, for example when the heat transfer medium is air, or it may be sent to another heat transfer device to cool the area when the heat transfer medium is liquid, such as used in a water cooled chiller. The refrigerant gas is then returned to the suction side of compressor 23 to complete the circuit. The closed loop system 21 immediately after expansion valve 31 to the suction side of compressor 23 is termed the low side of the circuit.

Figure 2:
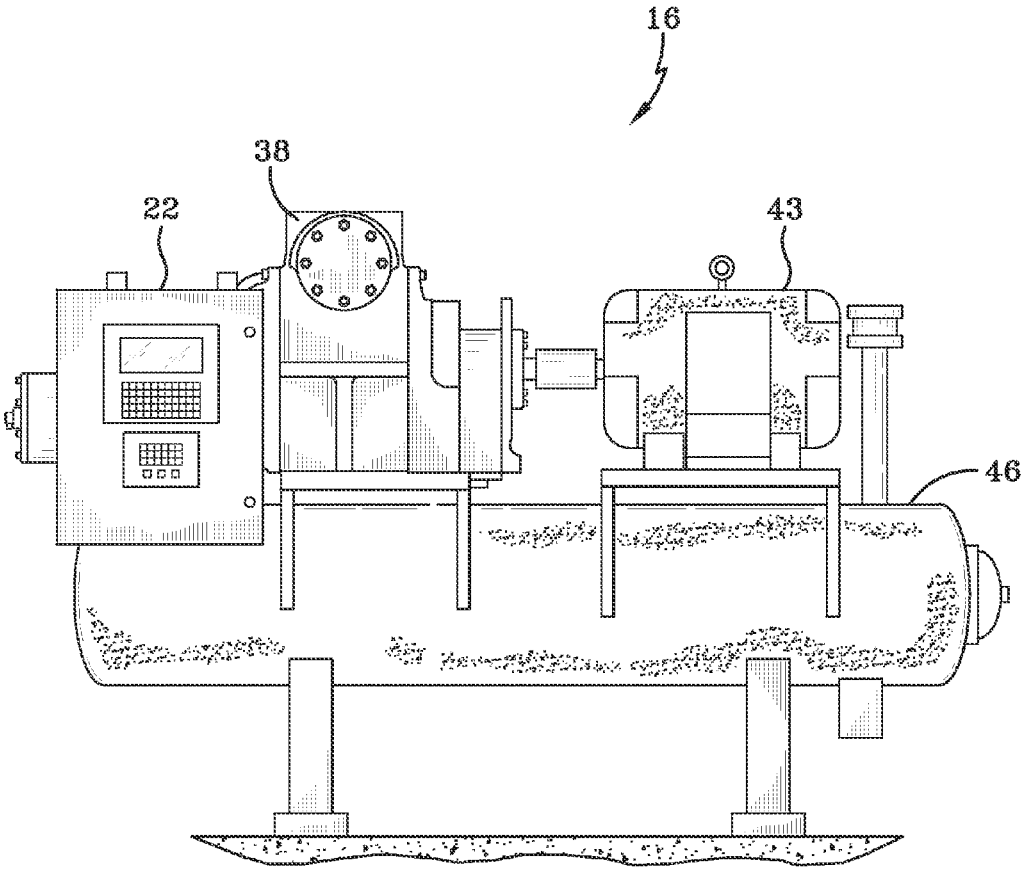
FIG. 2 schematically illustrates a typical screw compressor from the refrigeration cycle of claim 1.

Referring to FIG. 2, there is depicted a screw compressor 38 that may be used as compressor 23 in the refrigeration cycle of FIG. 1. Screw compressor 38 includes control panel 22 connected to a power source (not shown in FIG. 2), which is used to power a motor 43 that drives screw compressor 38. Screw compressor 38 is in fluid communication with oil separator 46. Refrigerant gas from evaporator 27 is introduced into the suction side of screw compressor 38 at the inlet port. A lubricant is also introduced into the screw compressor to lubricate the rotors of the compressor. Once compressed within screw compressor 38, the mixture of high pressure refrigerant gas and lubricant is discharged into oil separator 46 where the mist of lubricant in the form of finely divided particles entrained in the refrigerant gas is separated from the refrigerant gas. After separation, the refrigerant gas exits the oil separator 46 through its discharge port and is provided to condenser 25 in the closed loop system 21.

Figure 3:
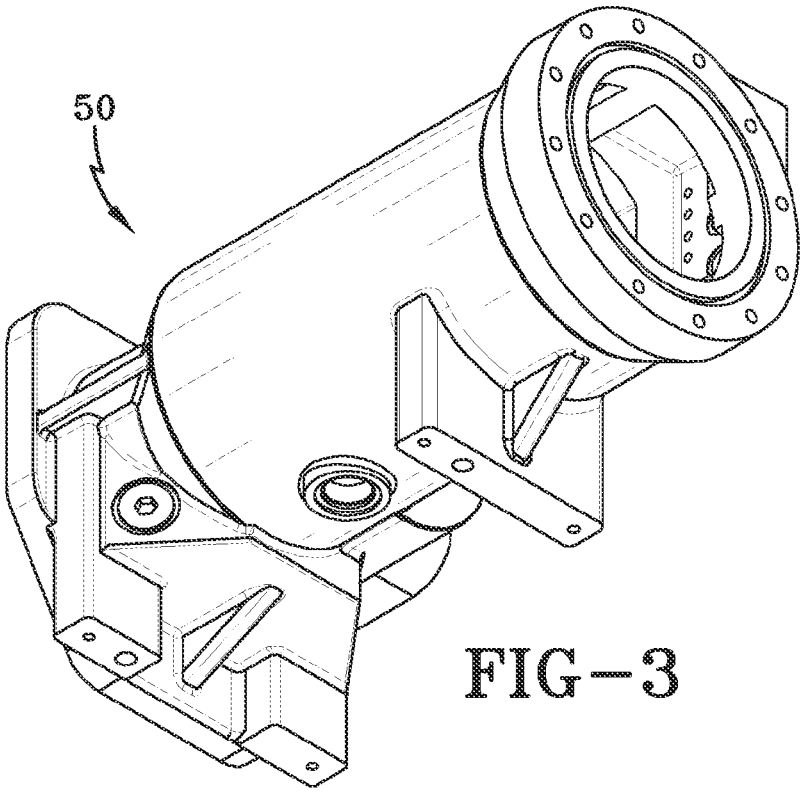
FIG. 3 depicts a housing for a screw compressor.
Figure 4:
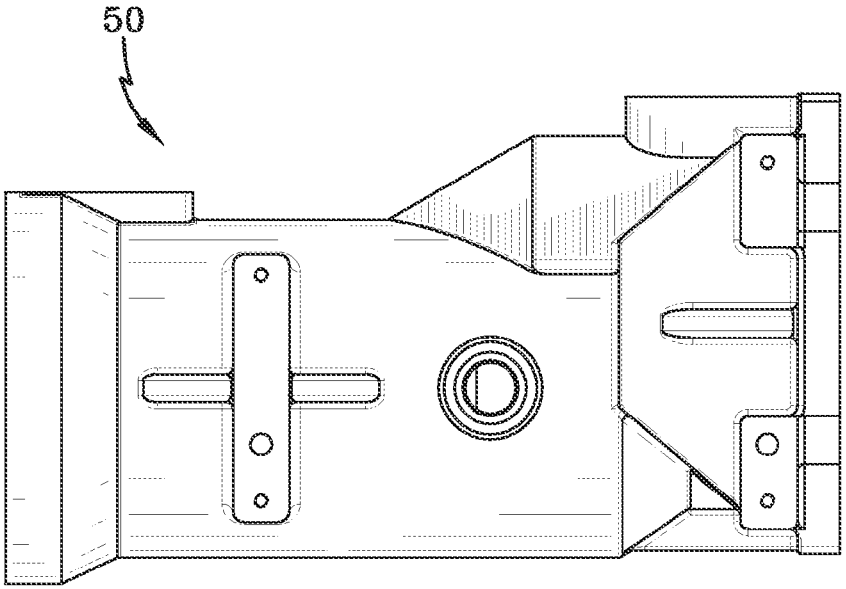
FIG. 4 is a side view of the housing of FIG. 3.
Figure 5:
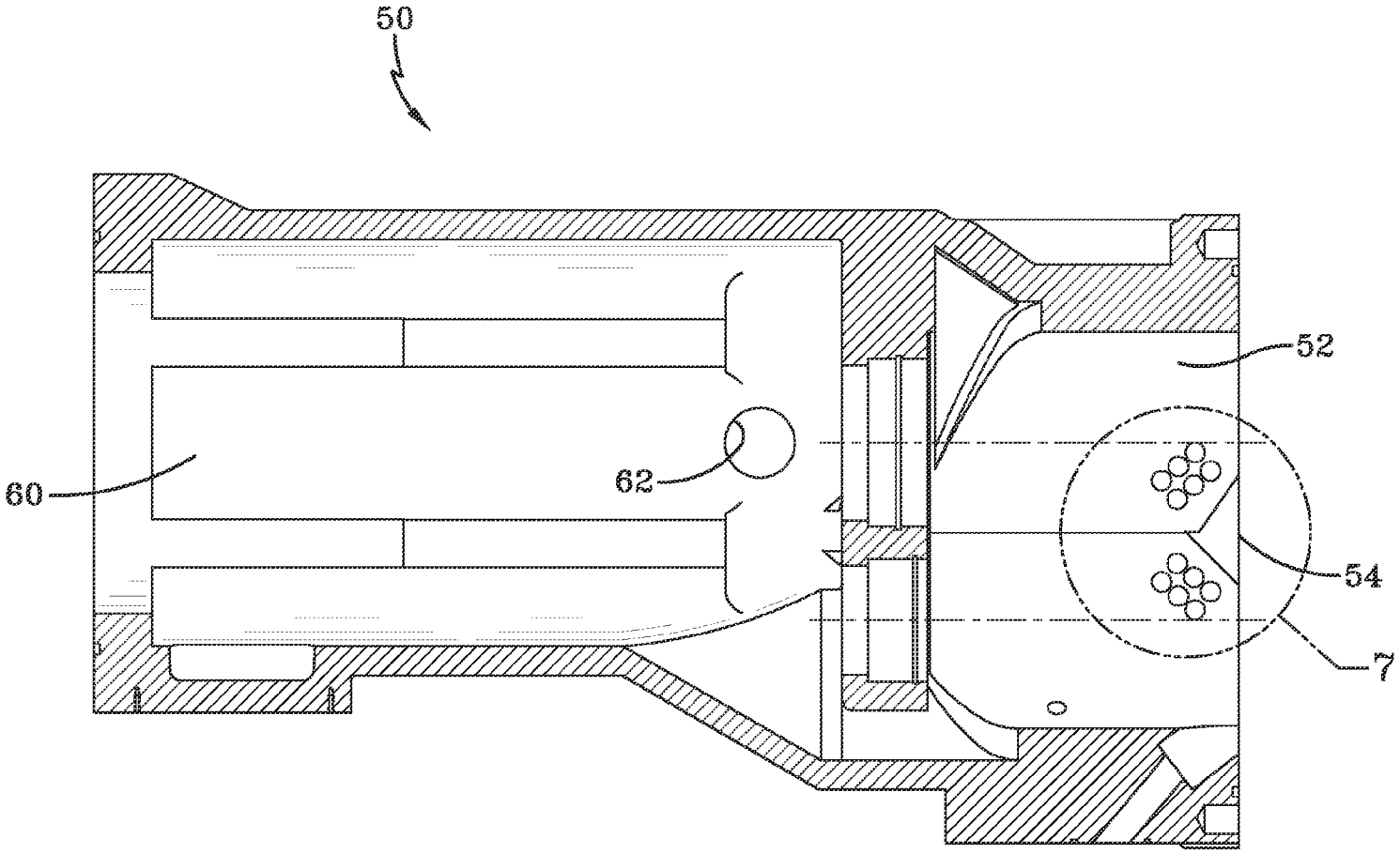
FIG. 5 is a cross-sectional view of the housing of FIGS. 3 and 4.
Figure 11:
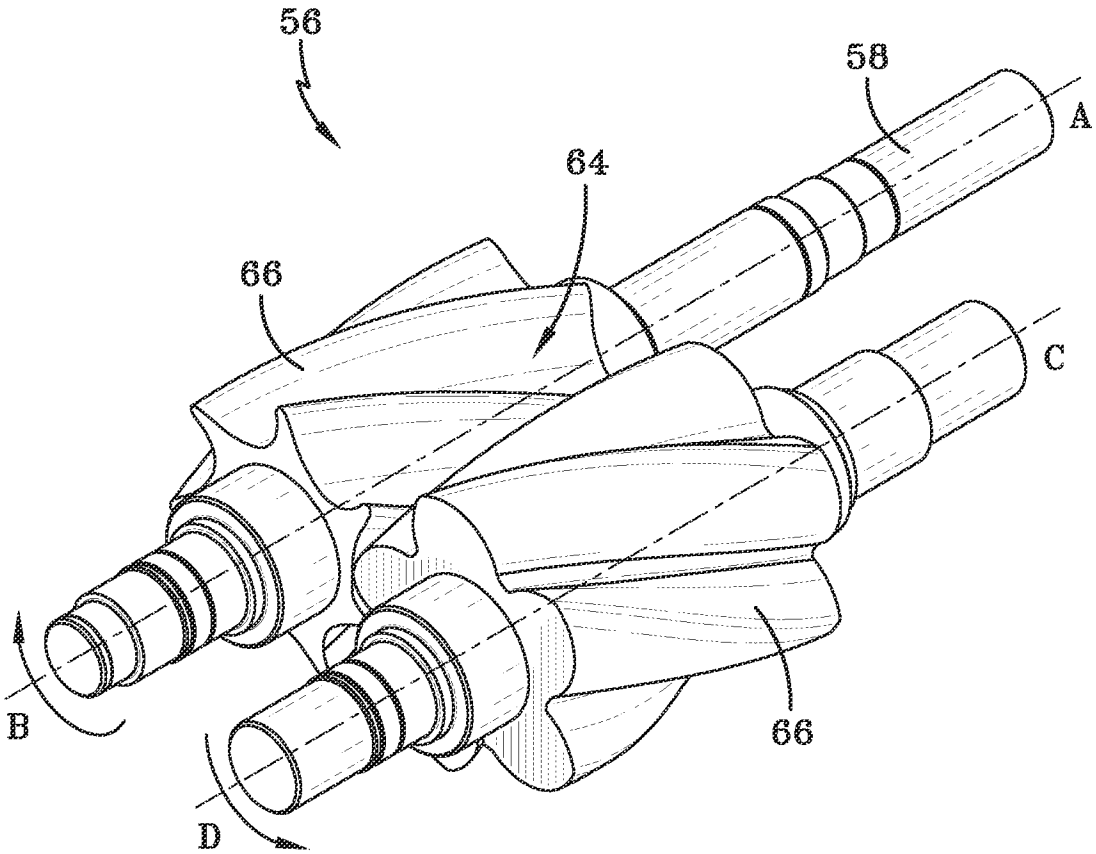
FIG. 11 depicts a pair of rotors that are located in the housing of a screw compressor.

FIG. 3 depicts a housing 50 for a screw compressor such as screw compressor 38. FIG. 4 is a side view of housing 50 of FIG. 3 and FIG. 5 is a cross-section of FIG. 4. A cavity 52 is located at an outlet end 54 of housing 50. A pair of rotors 56, depicted in FIG. 11, reside and operate in cavity 52, while a drive shaft 58 extends through cylindrical bore 60 of housing 50, FIG. 5. Drive shaft 58 is driven by motor 43, FIG. 2. A compressor inlet 62 extends through housing 50 to provide refrigerant gas to rotors 56 from the evaporator on the low pressure side of the housing. In screw compressor 38, gas entering housing 50 through inlet 62 fills interlobe region 64 between lobes 66 of rotors 54, is compressed as a result of rotor rotation and is discharged as a high pressure gas through a discharge port at outlet end 54.

Figure 6:
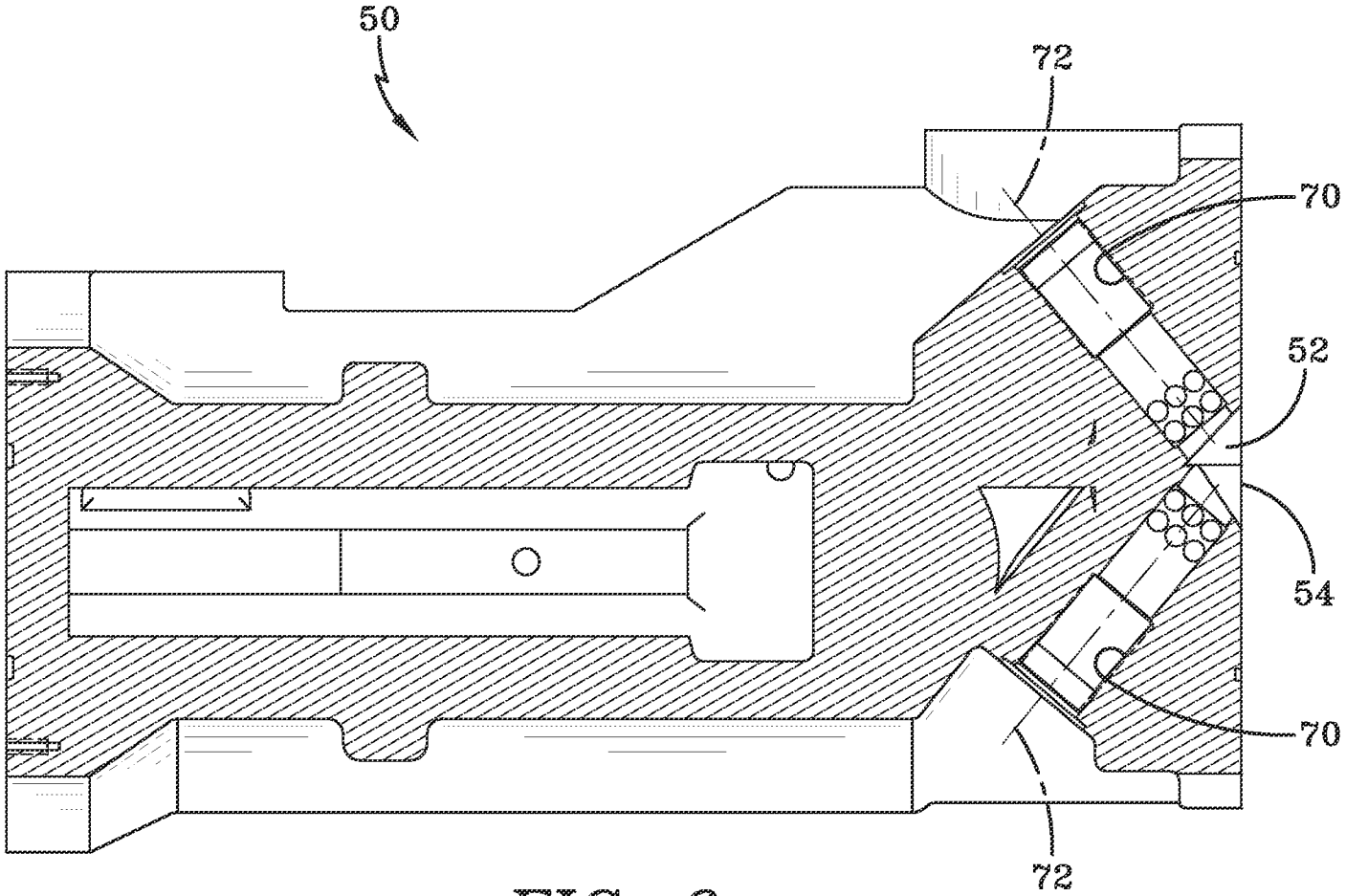
FIG. 6 is a cross-sectional view of the housing of FIGS. 3 and 4, the view being at 90° from the view of FIG. 5 depicting a penetration with apertures in the housing.

FIG. 6 is a cross-sectional view of housing 50 of FIG. 3 at 90° from the cross-sectional view of FIG. 5. A penetration 70 extends through housing 50 and into outlet end 54 along an axis 72 extending from the exterior of housing toward outlet end 54. As shown in FIG. 6, a pair of penetrations 70 extend through housing 50. At least one penetration 70 is required for the present invention, although any number suitable for the purpose may be provided. A plurality of apertures 74 (FIG. 7) extend within housing 50 from cavity 52 into penetration 70. These apertures 74 establish a flow path from cavity 52, FIG. 5, in which rotors 56 operate, to outlet end 54 through penetration 70, thereby effectively increasing the discharge volume which is the sum of the volume of the interlobal region at or immediately after compression+the volume of the discharge end as it discharged into outlet end 54.

Figure 7:
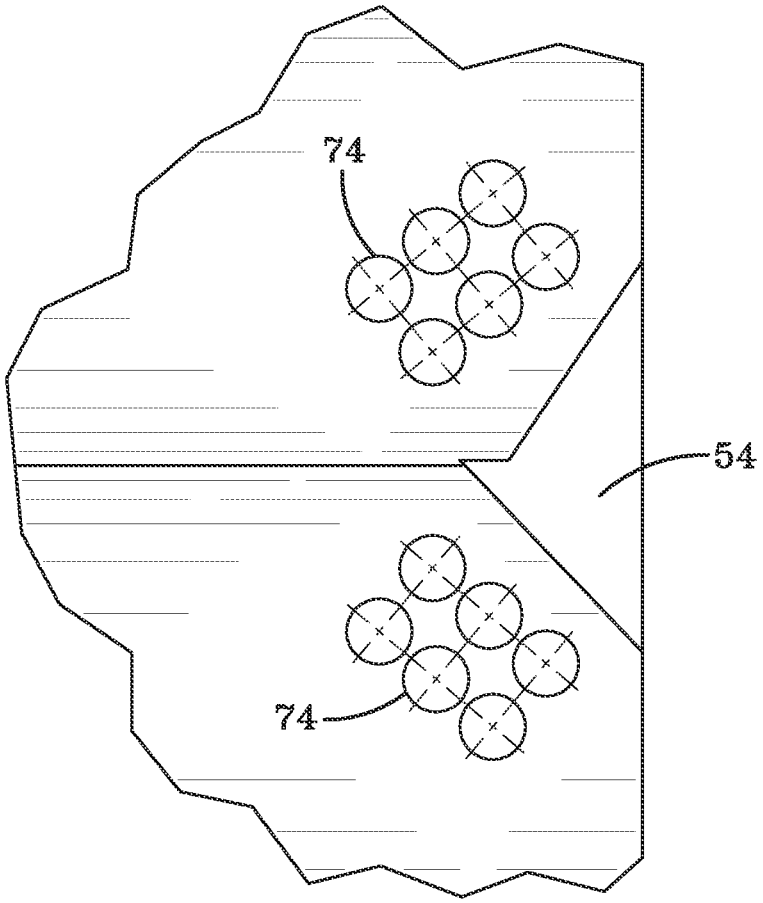
FIG. 7 is an enlarged view of apertures in the penetration in the housing of FIG. 6.

FIG. 7 provides a magnified view of the plurality of apertures 74, showing a preferred pattern for apertures 74 arranged axially along penetrations 70. However, apertures 74 may be arranged in any manner along penetration 70 and in any shape, as long as a flow path for refrigerant is created between cavity 52 in which the rotors are located and outlet end 54 through penetration 70.

Figure 8:
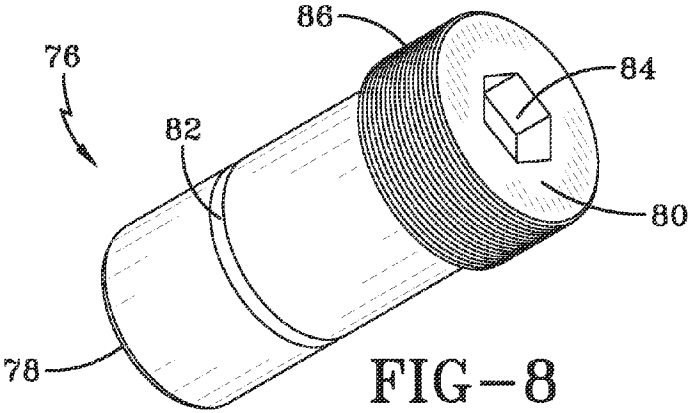
FIG. 8 is a perspective view of a member that is inserted into the penetration in the housing of FIG. 6.
Figure 10:
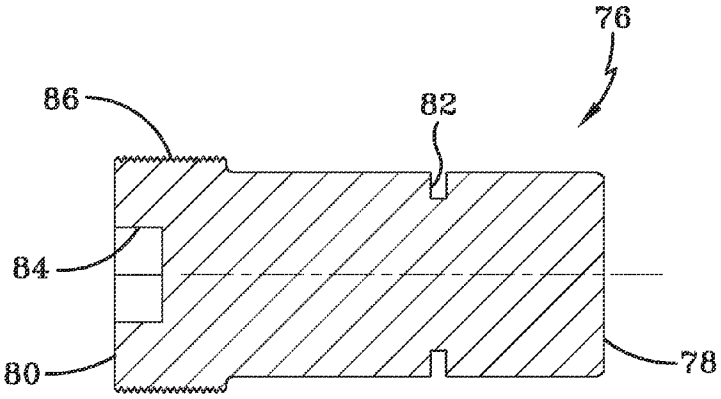
FIG. 10 is a cross-sectional view of the member of FIG. 8.
Figure 9:
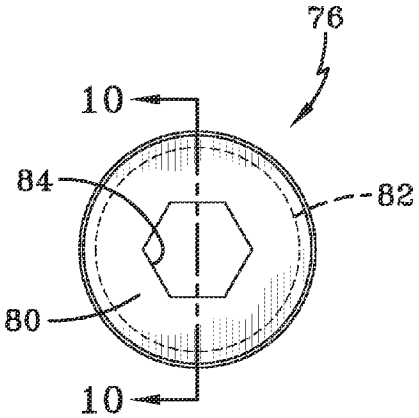
FIG. 9 is an end view of the member of FIG. 8.

FIGS. 8, 9 and 10 set forth a member 76 that is sized for insertion into penetration 70. Member 76 has a first end 78 and a second end 80. Member 76 is inserted into penetration 70 so that second end 80 is accessible from the exterior of housing 50. Member 76 is movable within penetration 70 so that first end 78 can be moved from a first position in which member 76 completely covers apertures 74, thereby completing blocking the flow path between cavity 52 through apertures 74 to outlet end 54, and a second position in which member 76 covers no portion of apertures 74 so that the flow path has maximum volume through apertures 74 to outlet end 54. Member 76 ideally can be positioned at any intermediate position between the first position at which the flow path is completely blocked and the second position at which the flow path volume is maximized, so that the flow path volume can be tailored by the adjustment of member 76 within penetrations 70. Since member 76 forms part of the gas boundary, it must be sealed to prevent gas leakage. As shown in FIGS. 8 and 10, which is a cross section, a groove 82 is provided on member 76 to provide a seating surface for insertion of a seal (not shown) that prevents leakage of gas between member 76 and penetration 70.

FIG. 9 is an end view of member 76. In this embodiment, a mechanical feature that facilitates movement of member 76, such as a hex head slot 84, is shown formed in second end 80 of member 76. While hex socket 84 that accepts a corresponding Allen wrench is disclosed in FIG. 9, any other configuration may be formed in second end to facilitate movement of member 76. Thus, any other groove or negative feature below the surface that accepts a tool of complementary geometry, such as a slot (for a screwdriver), a Torx socket or the like may also be used, although any other known configuration may be used. In addition, the member may include a positive feature at its end such as a hex head, and the corresponding tool may be a mating hex socket. While member 76 is shown as a piston having threads 86 at second end 80, it may also be a bolt or a screw, and penetration 70 is provided with mating threads. While threads are preferred, any other known arrangement for positioning a member in a penetration, such as a slotted penetration and a mating splined member may be used. A locking device is preferably provided so that the pressure from the compressed gas will not move member 76.

The compression ratio is provided as $$V_r = \epsilon^{1/\kappa}$$

where

V is the volume ratio $\epsilon$ is compression ratio and $\kappa$ is a refrigerant constant. For refrigerant R-134A, $\kappa$ is 1.8, but will vary when other refrigerants are used.

In operation, when member 76 is in its first position in which member 76 completely covers apertures 74, refrigerant gas enters the compressor through inlet 62 and fills interlobe region 64. Because member 76 completely covers apertures 74, there is no flow path for the refrigerant gas except into interlobe region 64 where it is compressed, so the refrigerant gas is fully compressed in interlobe region and achieves its maximum compression ratio. The volume ratio is the ratio of the suction volume to the discharge volume. In this first position, the suction volume is the volume of the interlobal region before compression. The discharge volume is the sum of the volume of the interlobal region after compression+the volume in the discharge end. The volume in the discharge end is at a minimum value when member 76 completely covers apertures 74, so that both volume ratio and compression ratio are at a maximum, which is the desired operating condition when extreme environmental conditions are experienced.

In operation, when member 76 is in its second position in which apertures 74 are not blocked, refrigerant gas enters the compressor through inlet 62 and fills interlobe region 64. Because member 76 does not completely cover apertures 74, there is a flow path for the refrigerant gas as it is compressed within interlobe region 64. As the rotors turn, a portion of refrigerant gas is discharged through this flow path before it can be fully compressed in interlobe region. In this circumstance, the refrigerant gas does not achieve its maximum compression ratio. In this second position, the suction volume is the volume of the interlobal region before compression. The discharge volume is the sum of the volume of the interlobal region after compression+the volume in the discharge end+the volume of the additional flow path through apertures 74 and penetration 70 (which is bounded by member 76). As can be seen, positioning of member 76 can decrease the volume ratio from a maximum wherein the apertures are fully blocked to a minimum wherein member 76 is fully withdrawn. The compression ratio is also reduced, which is desired when environmental conditions are not severe. As used herein, severe operating conditions refer to the environmental conditions for which the compressor is designed to run at maximum compression, without overcompression.

The difference between a first position of member 76 and a second position of member 76 is the volume change that occurs as member 76 is moved within penetration 70. The volume change can be further increased by moving member 76 further outward to increase the volume within penetration 70. Besides $V_r$ control, there is also another advantage that will be offered by such a mechanism. This advantage also is affected by the characteristics of the discharge port area as a plenum of fixed volume that gas flows into and out of at some rate. The volume may be favorable or unfavorable for sound generation depending upon pressure, temperature, and frequency of the gas moving through the plenum. There can be an infinite number of resonances that can occur given a wide range of operating speed of the screw, types of gases being compressed, as well as the pressure and temperatures of the gases. Changing the volume by adjusting the position of member 76 within penetration 70 may attenuate certain frequencies, thereby reducing noise or vibration and terminating these effects before they can achieve a resonance that excite discharge piping or components. This type of termination is similar to the phenomenon seen in a Helmholtz resonator.

As a practical matter, in extremely hot environmental conditions as occur in summer conditions, the screw compressor operates most efficiently when it is operating producing the highest refrigerant pressures. This condition is achieved when member 76 is in a first position completely blocking apertures 74 in housing 50 so that there is no alternate flow path for the flow of refrigerant and all apertures are blocked by member 76, the volume ratio being at a maximum. However, when the environmental conditions are not as extreme, for example in the winter, member 76 can be adjusted so that apertures 74 are not blocked and the flow path for the refrigerant from interlobe region 64, through apertures 74 into penetration 70 and into the discharge volume at outlet end 54 is maximized. The volume ratio will be reduced and the system will operate more efficiently at part load conditions, providing energy savings. Importantly, the adjustment from full load at position one to part load at position two, or any part load condition desired between position one and position two can be accomplished by adjusting member 76 without having to shut down or otherwise disassemble screw compressor 38. With the appropriate tool, member 76 can be adjusted inwardly or outwardly to achieve the desired volume ratio to match the environmental conditions. Furthermore, this adjustment can readily be made as often as the environmental conditions change. Thus, member 76 can be adjusted as required to an intermediate position between a first position and a second position during autumn and spring seasons.

Another advantage of this invention is that the manufacturer can provide the same screw compressor design (in terms of tonnage capacity) and provide for efficient operation by adjusting the position of member 76 within penetration 70 based on the temperatures experienced in a wide range of climates. Thus, the same compressor can be shipped to, for example, to subarctic climates or subtropics climates, and the volume ratio can readily be adjusted to match the climactic conditions by varying the position of member 76 within penetration 70 between its first position and its second position.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A screw compressor having an adjustable volume ratio, comprising:

a power source;

a motor connected to the power source;

a control panel that controls the power source and the motor;

a housing having a cavity, the housing in fluid communication with an inlet end and in fluid communication with an outlet end;

rotors positioned in the housing cavity, the rotors having lobes and an interlobe region between the lobes compressing a refrigerant as received from the inlet end and discharged to the outlet end;

a drive shaft connected to the motor rotating the rotors;

a penetration in the housing, the penetration including at least one aperture, the at least one aperture providing a flow path from the interlobe region through the penetration to the outlet end;

a member selectively positioned within the penetration, the member having a first end and a second end, the member selectively movable from outside the housing without compressor disassembly between a first position, in which the member blocks one or more apertures of the at least one aperture providing a minimum discharge volume with no flow path from the interlobe region to the outlet end to a second position, in which a flow path is provided from the interlobe region through the at least one aperture providing a maximum discharge volume, the compressed gas being discharged from the interlobe region through the at least one aperture to the outlet end; and wherein the selective position of the member within the penetration determines a volume ratio of the compressor.

2. The screw compressor of claim 1 wherein the second end of the member further includes a mechanical feature is accessible from the exterior of the housing, selectively positioning the member within the penetration.

3. The screw compressor of claim 2 wherein the mechanical feature in the second end of the member is a hex head.

4. The screw compressor of claim 2 wherein the mechanical feature is a groove.

5. The screw compressor of claim 4 wherein the groove is a hex socket.

6. The screw compressor of claim 1 wherein one of the member and the housing further includes a locking device to prevent movement of the member within the penetration once the member is selectively positioned.

7. The screw compressor of claim 1 further including a seal between the member and the housing to prevent leakage of gas there between.

8. The screw compressor of claim 1 wherein when the member is selectively positioned at the first position within the penetration during summer, the discharge volume is at its minimum, the volume ratio and a compression ratio of the screw compressor are at a maximum.

9. The screw compressor of claim 1 wherein when the member is selectively positioned at the second position during winter so that compressed gas discharged from the interlobe region passes into the discharge volume, the discharge volume is at maximum, the volume ratio and a compression ratio of the screw compressor are at a minimum.

10. The screw compressor of claim 1 wherein when the member is selectively positioned at an intermediate position between the first position and the second position during autumn and spring, compressed gas is discharged from the interlobe region passing into the discharge volume, wherein the discharge volume is at an intermediate volume between the minimum volume at the first position and the maximum volume at the second position, the volume ratio and a compression ratio of the screw compressor being at intermediate ratios between a maximum and a minimum.

11. The screw compressor of claim 1 wherein the refrigerant gas is R-134A.

12. A closed loop refrigeration system, comprising:

a compressor for increasing the pressure of a refrigerant gas;

a condenser in fluid communication with the compressor, the condenser condensing the pressurized refrigerant gas to a pressurized refrigerant liquid;

an expansion valve in fluid communication with the condenser, the expansion valve reducing the pressure of the pressurized refrigerant liquid while converting the refrigerant into a mixture of gas and liquid;

an evaporator in fluid communication with the expansion valve and the compressor, the evaporator evaporating the refrigerant liquid to a refrigerant gas while absorbing heat from a heat transfer medium, thereby cooling the heat transfer medium;

wherein the compressor further comprises a screw compressor having;

a power source, a motor connected to the power source, a control panel that controls the power source and the motor, a housing having a cavity, the housing in fluid communication with an inlet end and in fluid communication with an outlet end for discharging the refrigerant gas, rotors positioned in the housing cavity, the rotors having lobes and an interlobe region between the lobes to compress a refrigerant gas discharged to the outlet end, a drive shaft connected to the motor rotating the rotors, a penetration in the housing, the penetration including at least one aperture, the at least one aperture providing a flow path from the interlobe region through the penetration to the outlet end, a member selectively positioned within the penetration, the member having a first end and a second end, the member selectively movable from outside the housing without compressor disassembly between a first position, in which the member blocks one or more apertures of the at least one aperture providing a minimum discharge volume with no flow path from the interlobe region to the outlet end and a second position, in which a flow path is provided from the interlobe region through the at least one aperture providing a maximum discharge volume, the compressed gas being discharged from the interlobe region through the at least one aperture to the outlet end; and wherein the selective position of the member within the penetration determines a volume ratio of the compressor.

13. The refrigeration system of claim 12 wherein the second end of the member further includes a mechanical feature accessible from the exterior of the housing selectively positioning the member within the penetration.

14. The refrigeration system of claim 12 further including a seal between the member and the housing of the screw compressor to prevent leakage of gas therebetween.

15. The refrigeration system of claim 14 wherein when the screw compressor member is selectively positioned at the first position within the penetration, the discharge volume is at its minimum and the volume ratio and a compression ratio of the screw compressor are at a maximum, and when the screw compressor member is selectively positioned at the second position within the penetration, the discharge volume is at a maximum and the volume ratio and the compression ratio of the screw compressor are at a minimum.

16. The refrigeration system of claim 15 wherein when the member is selectively positioned at an intermediate position between the first position and the second position so that compressed gas discharged from the interlobe region passes into the discharge volume, wherein the discharge volume is at the intermediate volume between the minimum volume at the first position and the maximum volume at the second position, the volume ratio and the compression ratio of the screw compressor are intermediate between the maximum volume ratio and compression ratio and the minimum volume ratio and compression ratio.

* * * * *